United States Patent [19]

Williams

[11] Patent Number: 4,539,959

[45] Date of Patent: Sep. 10, 1985

[54] FUEL INJECTION SYSTEM WITH FUEL FLOW LIMITING VALVE ASSEMBLY

[75] Inventor: Donald L. Williams, Port Clinton, Ohio

[73] Assignee: General Motors Corporation, Detroit, Mich.

[21] Appl. No.: 583,709

[22] Filed: Feb. 27, 1984

[51] Int. Cl.[3] ..... F02M 37/04

[52] U.S. Cl. ..... 123/456; 123/457; 123/198 DB; 137/498; 137/513.5

[58] Field of Search ..... 123/457, 456, 510–513, 123/198 DB, 198 D; 137/498, 513.5, 539, 543.17; 251/360

[56] References Cited

U.S. PATENT DOCUMENTS

| | | | |
|---|---|---|---|
| 2,307,949 | 1/1943 | Phillips | 137/498 |
| 2,530,128 | 11/1950 | Mashinter | 417/394 |
| 2,630,761 | 3/1953 | Mashinter | 417/394 |
| 2,798,769 | 7/1957 | Whitson | 239/145 |
| 3,085,589 | 9/1963 | Sands | 137/498 |
| 3,392,714 | 7/1968 | Braun et al. | 123/456 |
| 3,847,020 | 11/1974 | Jursehak | 73/228 |
| 3,901,475 | 8/1975 | Dreibelbis | 251/360 |
| 4,427,151 | 1/1984 | Trenne | 239/87 |
| 4,448,066 | 5/1984 | Romblom et al. | 73/119 A |
| 4,467,757 | 8/1984 | Dazzi | 123/198 DB |

*Primary Examiner*—Magdalen Y. C. Moy
*Attorney, Agent, or Firm*—C. K. Veenstra

[57] ABSTRACT

In a fuel injection system having an injector which delivers fuel to an engine in discrete injection events, a valve assembly shuts off fuel flow to the injector if the fuel flow during an injection event exceeds a desired upper limit.

3 Claims, 2 Drawing Figures

FUEL INJECTION SYSTEM WITH FUEL FLOW LIMITING VALVE ASSEMBLY

TECHNICAL FIELD

This invention relates to a fuel injection system having an injector which delivers fuel to an engine in discrete injection events.

SUMMARY OF THE INVENTION

Fuel injection systems for diesel engines, and for some gasoline engines, have injectors which deliver fuel to the engine in discrete injection events. In such a system, both the duration of an injection event and the quantity of fuel delivered during an injection event vary below desired maximums. An injection event which extends beyond the desired maximum duration, or a fuel flow which exceeds the maximum desired for an injection event in either duration or quantity, is an indication of a malfunction.

This invention provides a fuel injection system with a fuel flow limiting valve assembly which automatically shuts off fuel flow to an injector in the event the duration of an injection event exceeds a desired maximum. This invention also provides a fuel injection system with a fuel flow limiting valve assembly which automaticallty shuts off fuel flow to an injector in the event the duration of fuel flow to the injector exceeds a desired maximum. Moreover, this invention provides a fuel injection system with a fuel flow limiting valve assembly which automatically shuts off fuel flow to an injector in the event the quantity of fuel flowing to an injector exceeds the maximum desired for an injection event.

In a preferred embodiment of a fuel flow limiting valve assembly employed in this invention, a valve body has a bore through which fuel flows to the injector for delivery to the engine. A valve member is reciprocable in the bore between a valve seat and a rest position upstream of the valve seat. The valve member is displaced from the rest position toward the valve seat by fuel flow through the bore, and the extent of such displacement varies with the duration or quantity of fuel flow through the bore. The distance between the rest position and the valve seat equals the extent of such displacement when the duration or quantity of fuel flow exceeds the maximum desired for an injection event. Thus when the duration or quantity of fuel flow exceeds the maximum desired for an injection event, the valve member engages the valve seat to preclude fuel flow to the injector. The valve assembly includes return means such as a spring for restoring the valve member to the rest position between successive injection events when the valve member is not engaging the valve seat; however, if the valve member is engaging the valve seat, the return spring cannot restore the valve member to the rest position.

The details as well as other features and advantages of a preferred embodiment of this invention are set forth in the remainder of the specification and are shown in the accompanying drawing.

THE PREFERRED EMBODIMENT

Figure 1:
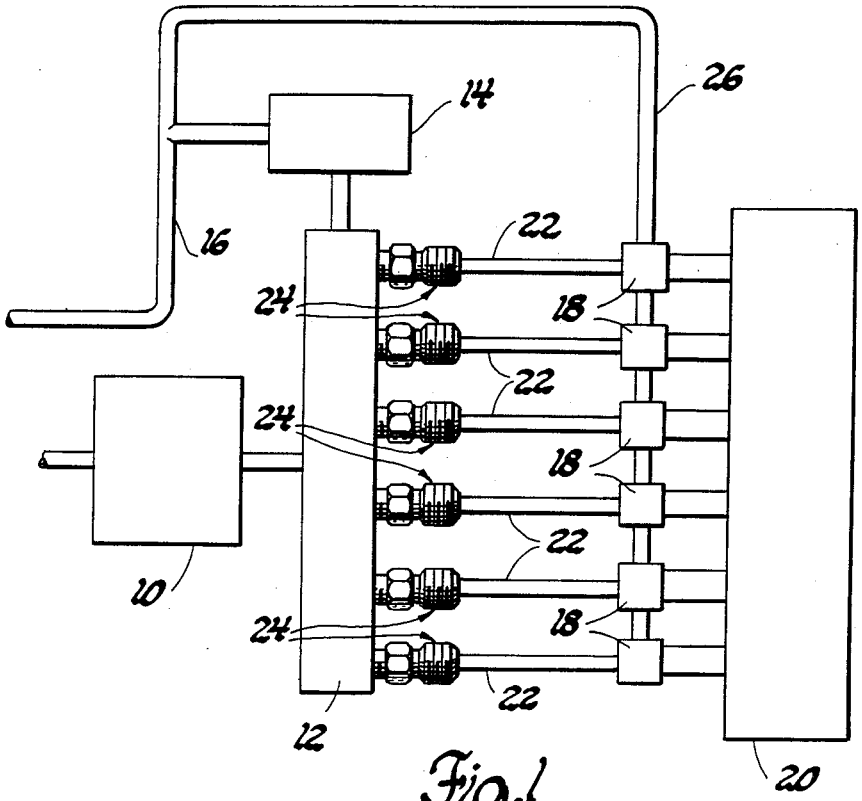
FIG. 1 is a schematic diagram of a diesel engine common rail fuel injection system employing a fuel flow limiting valve assembly according to this invention.

Referring to the drawing, a pump 10 supplies fuel from a fuel tank to a fuel rail 12. A pressure regulator 14 maintains fuel rail 12 at a desired injection pressure and discharges excess fuel through a line 16 for return to the fuel tank.

A plurality of injectors 18 delivers fuel from fuel rail 12 to an engine 20. Each injector 18 is connected to fuel rail 12 through a supply line 22 and a fuel flow limiting valve assembly 24. Injectors 18 also have an internal leak path connected to discharge line 16 through an interconnecting line 26.

Figure 2:
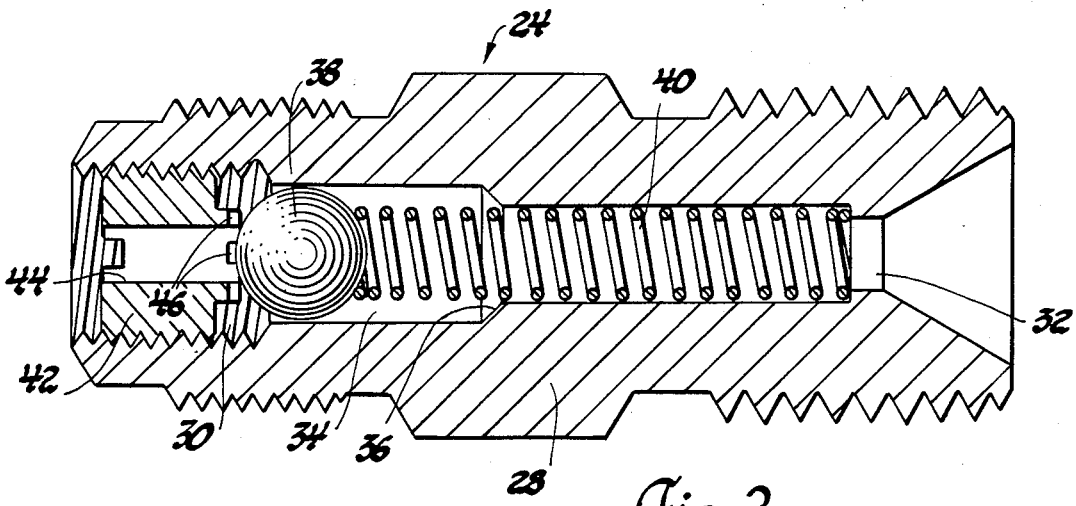
FIG. 2 is an enlarged sectional view of the fuel flow limiting valve assembly employed in the FIG. 1 system.

As shown in FIG. 2, each fuel flow limiting valve assembly 24 includes a valve body 28 having an inlet 30 which receives fuel from fuel rail 12 and an outlet 32 which discharges fuel through line 22 to injector 18. Valve body 28 has a bore 34 which extends from inlet 30 to outlet 32 and includes a portion defining a valve seat 36. A valve ball 38 is disposed in and has a close fit within bore 34—only 0.001–0.002 inch (25–50 $\mu$m) diametral clearance is provided between ball 38 and bore 34. A spring 40 biases ball 38 away from seat 36 to a rest position engaging a stop 42 threaded into inlet 30. Stop 42 has a central axial bore 44 and several lateral openings 46 which allow fuel to flow through stop 42 into bore 34.

During operation, actuation of injector 18 to deliver fuel from fuel rail 12 to engine 20 reduces the pressure in bore 34 downstream of ball 38, and ball 38 responds to the difference between that reduced pressure and the injection pressure in bore 34 upstream of ball 38—moving rightwardly toward seat 36. Because of the close fit between ball 38 and bore 34, the displacement of ball 38 toward seat 36 continues during the time fuel flows through outlet 32 and thus varies with the time injector 18 is actuated—the duration of the injection event—and with the quantity of fuel flow through valve assembly 24 during an injection event. Upon termination of the injection event, fuel flowing through the narrow clearance between ball 38 and bore 34 increases the pressure in bore 34 downstream of ball 38, and spring 40 gradually returns ball 38 to the rest position shown.

In this particular fuel injection system, the injection events have a duration varying below a maximum of about two milliseconds. Should fuel flow through bore 34 for about five milliseconds, ball 38 will engage seat 36 to interrupt and preclude further fuel flow through bore 34. With ball 38 engaging seat 36, fuel cannot flow past ball 38 to increase the pressure downstream of ball 38. Thus as long as the injection pressure of fuel rail 12 is applied to inlet 30, spring 40 is unable to move ball 38 away from seat 36.

It will be appreciated, therefore, that each fuel flow limiting valve assembly 24 shuts off fuel flow to its injector 18 in the event of a malfunction resulting in fuel flow to its injector which exceeds the maximum time required for an injection event or the maximum quantity of fuel desired for an injection event.

The embodiments of the invention in which an exclusive property or privilege is claimed are defined as follows:

1. In a fuel injection system having an injector which delivers fuel to an engine during discrete injection events and wherein the time required for said injector to deliver fuel to the engine during an event has a desired upper limit: a valve assembly limiting fuel flow to said injector, said assembly comprising a valve body having a bore through which fuel flows to said injector, said bore including a portion defining a valve seat, a valve member reciprocable in said bore between said valve seat and a rest position upstream of said valve seat, said valve member being displaceable from said rest position toward said valve seat by the difference between the pressure in said bore upstream of said valve member and the pressure in said bore downstream of said valve member which occurs when fuel flows through said bore to said injector, such displacement continuing during the time fuel flows through said bore, the distance between said rest position and said valve seat equalling the extent of such displacement when the time fuel flows through said bore exceeds said upper limit, whereby said valve member engages said valve seat to preclude fuel flow through said bore when the time fuel flows through said bore exceeds said upper limit, and return means effective for restoring said valve member to said rest position only when the pressure in said bore downstream of said valve member is substantially equal to the pressure in said bore upstream of said valve member.

2. In a fuel injection system having an injector which delivers fuel to an engine in discrete injection events and wherein the duration of an event has a desired upper limit: a valve assembly limiting fuel flow to said injector, said assembly comprising a valve body having a bore through which fuel flows to said injector, said bore including a portion defining a valve seat, a valve member reciprocable in said bore between said valve seat and a rest position upstream of said valve seat, said valve member being displaceable from said rest position toward said valve seat by fuel flow through said bore, the extent of such displacement varying with the duration of the injection event, the distance between said rest position and said valve seat equalling the extent of such displacement when the duration exceeds said upper limit, whereby said valve member engages said valve seat to preclude fuel flow through said bore to said injector when the duration of an injection event exceeds said upper limit, and return means effective for restoring said valve member to said rest position between successive injection events when said valve member is not engaging said valve seat, said return means being ineffective for restoring said valve member to said rest position when said valve member is engaging said valve seat.

3. In a fuel injection system having an injector which delivers fuel to an engine during discrete injection events and wherein the quantity of fuel delivered during an event has a desired upper limit: a valve assembly limiting fuel flow to said injector, said assembly comprising a valve body having a bore through which fuel flows to said injector, said bore including a portion defining a valve seat, a valve member reciprocable in said bore between said valve seat and a rest position upstream of said valve seat, said valve member being displaceable from said rest position toward said valve seat by fuel flow through said bore, the extent of such displacement varying with the quantity of fuel flowing through said bore during an injection event, the distance between said rest position and said valve seat equalling the extent of such displacement when such quantity exceeds said upper limit, whereby said valve member engages said valve seat to preclude fuel flow through said bore to said injector when the quantity of fuel flowing through said bore during an injection event exceeds said upper limit, and return means effective for restoring said valve member to said rest position between successive injection events when said valve member is not engaging said valve seat, said return means being ineffective for restoring said valve member to said rest position when said valve member is engaging said valve seat.

* * * * *